US010704224B1

(12) United States Patent
Hauer

(10) Patent No.: US 10,704,224 B1
(45) Date of Patent: Jul. 7, 2020

(54) GRADING DEVICE FOR SKID STEER EQUIPMENT

(71) Applicant: Evan Hauer, Moscow Mills, MO (US)

(72) Inventor: Evan Hauer, Moscow Mills, MO (US)

( * ) Notice: Subject to any disclaimer, the term of this patent is extended or adjusted under 35 U.S.C. 154(b) by 64 days.

(21) Appl. No.: 15/609,939

(22) Filed: May 31, 2017

Related U.S. Application Data

(60) Provisional application No. 62/343,341, filed on May 31, 2016.

(51) Int. Cl.

| | |
|---|---|
| ***E02F 3/76*** | (2006.01) |
| ***E02F 9/22*** | (2006.01) |
| ***E02F 9/28*** | (2006.01) |
| ***E02F 3/815*** | (2006.01) |

(52) U.S. Cl.
CPC ..... *E02F 3/7604* (2013.01); *E02F 3/7609* (2013.01); *E02F 3/7618* (2013.01); *E02F 3/7622* (2013.01); *E02F 3/8152* (2013.01); *E02F 9/2271* (2013.01); *E02F 9/2883* (2013.01)

(58) Field of Classification Search
CPC ..... E02F 3/7604; E02F 3/7609; E02F 3/7618; E02F 3/7622
See application file for complete search history.

(56) References Cited

U.S. PATENT DOCUMENTS 2,710,467 A * 6/1955 Cundiff, Sr. ..... E02F 3/7627 172/445.2
3,058,243 A * 10/1962 McGee ..... A01B 35/14 172/197
3,233,350 A 2/1966 Gottschalk et al.
3,470,964 A 10/1969 Collins et al.
3,656,557 A * 4/1972 Eskelson et al. ..... A01B 31/00 37/219
3,755,930 A * 9/1973 Brandt et al. ..... E01H 5/068 37/219
4,189,009 A * 2/1980 Welch ..... E02F 3/7663 172/384
4,892,155 A 1/1990 Wanamaker
5,562,398 A * 10/1996 Knutson ..... E02F 3/3414 37/903
6,318,006 B1 11/2001 Hall
6,360,459 B1 * 3/2002 Brookhart et al. ..... E02F 3/345 172/825
6,860,039 B2 * 3/2005 Schultz et al. ..... E01H 5/063 172/273
8,083,005 B1 * 12/2011 Nicolai ..... E02F 3/7631 172/393
8,322,947 B2 12/2012 Neumann
2003/0136568 A1 * 7/2003 McReynolds et al. ... E02F 3/34 172/817
2004/0244233 A1 12/2004 Johnson
2007/0012464 A1 * 1/2007 Juergen ..... A01B 31/00 172/145
2008/0187426 A1 8/2008 Page
2013/0008061 A1 1/2013 Melrose
2015/0107861 A1 * 4/2015 Keigley ..... A01B 63/108 172/1

* cited by examiner

*Primary Examiner* — Thomas B Will
*Assistant Examiner* — Joel F. Mitchell
(74) *Attorney, Agent, or Firm* — Cramer Patent & Design, PLLC; Aaron R. Cramer

(57) ABSTRACT

A grading device is attachable to skid steer equipment. The device is fashioned as a standard bucket attachment secured to a box or dozer blade. The bucket attachment is configured to secure to the universal attachment arm of skid steer equipment.

3 Claims, 6 Drawing Sheets

GRADING DEVICE FOR SKID STEER EQUIPMENT

RELATED APPLICATIONS

The present invention is a Continuation-in-Part of the first invention described in and claiming the benefit of U.S. Provisional Patent Application No. 62/343,341 filed on May 31, 2016, the entire disclosures of which are incorporated herein by reference.

FIELD OF THE INVENTION

The present invention relates generally to a grading attachment attachable to a skid steer loading machine.

BACKGROUND OF THE INVENTION

Skid steer loaders are very handy vehicles commonly used around farms, nurseries, and for general landscaping and maintenance. Their small size and maneuverability allows them to operate in tight spaces. Their light weight allows them to be towed behind a full-size pickup truck, and the wide array of attachable accessories makes them very flexible. They are commonly used by landscapers to dig, plant large trees, move landscaping and building materials, and a wide variety of other tasks.

Many users attempt to use the bucket attachment for grading, but such use typically generates unsatisfactory results and may even be a safety factor when grading sloped areas. Accordingly, there exist a need for a means by which skid steer loaders can be used for grading operations without the disadvantages as described above. The development of the device fulfills this need.

SUMMARY OF THE INVENTION

In view of the foregoing disadvantages inherent in the prior art, it has been observed that there is need of a grading attachment attachable to a skid steer loading machine.

The object of the present invention is to provide a grading attachment, comprising a frame which has an outer support sleeve attached thereto via a plurality of support braces, an inner support shaft secured to an end of the outer support sleeve, further having a distal end affixed to a base plate, an attachment blank affixed to the base plate, a plurality of stiffening plates, each connected to the frame and a front blade hingedly attached to each of the plurality of stiffening plates. The inner support shaft rotates within the outer support sleeve while the attachment blank is configured to attach to a skid steer loading machine, thereby enabling the skid steer loading machine to operably control the grading attachment. In a separate configuration, a grading machine comprises the skid steer loading machine and the grading attachment.

The grading attachment may comprise of a plurality of gusset plates affixing the inner support shaft to the base plate or a plurality of wear plates affixed to lower surfaces of the frame. Each of the plurality of wear plates further comprises high carbon steel. While an abrasion wear plate may be attached to the front blade.

The grading attachment may comprise of a plurality of tilling bars, each held in position between adjacent ones of the plurality of stiffening plates. The plurality of tilling bars may further comprise a plurality of teeth and may be made of high carbon steel. The frame may also comprise a rectangular shape and have a hydraulic cylinder. The hydraulic cylinder is secured to the base plate at a first end and secured to the grading frame at a second end. The movement of the hydraulic cylinder in a first direction moves the grading frame in a first direction while the movement of the hydraulic cylinder in a second direction moves the grading frame in a second direction.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
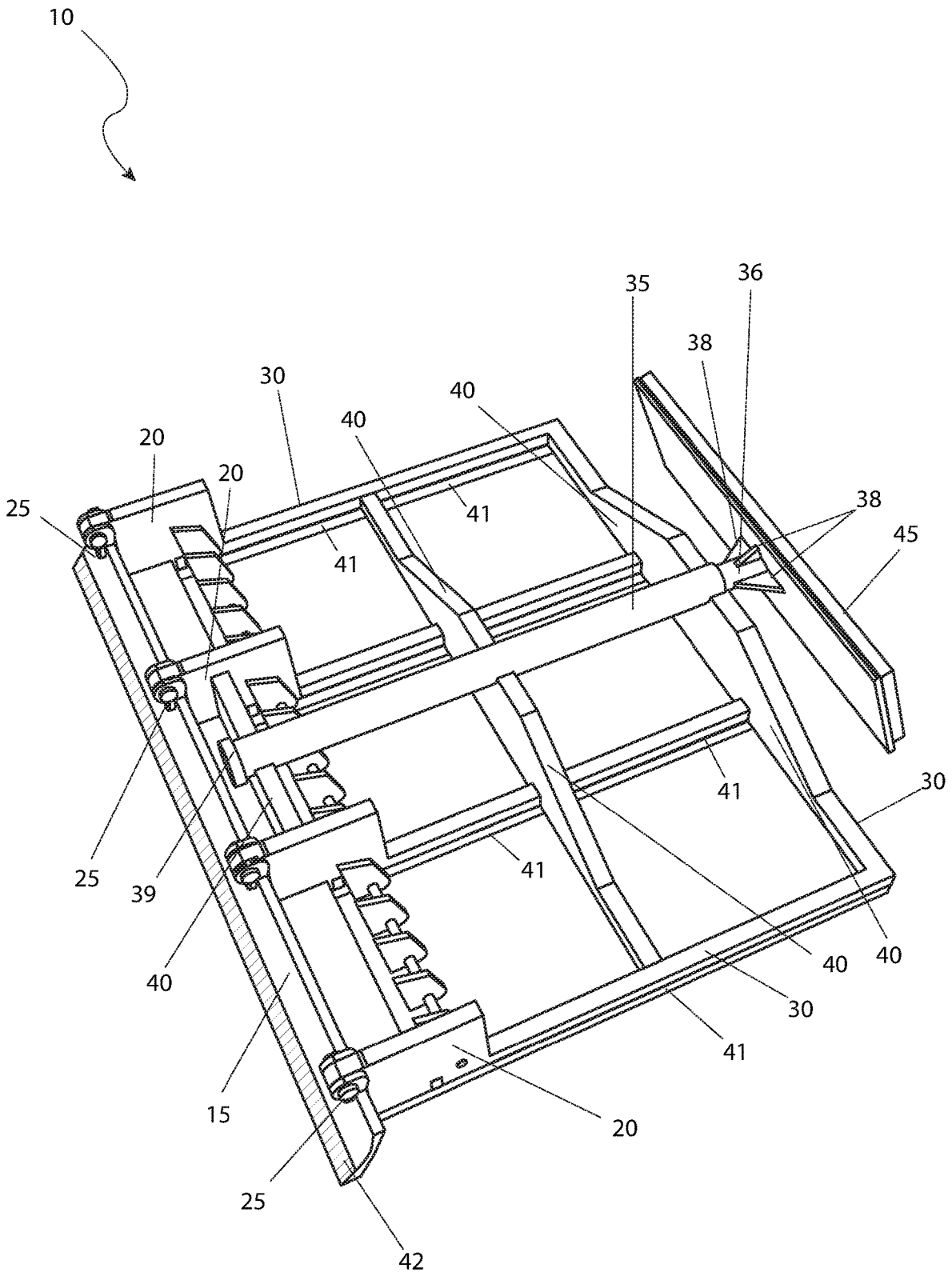
FIG. 1 is an isometric view of the grading attachment 10 for a skid steer loading machine 55, according to the preferred embodiment of the present invention.

10 grading attachment
15 front blade
20 stiffening plate
25 hinge assembly
30 grading frame
35 outer center sleeve
36 inner support shaft
37 base plate
38 gusset plate
39 welded retaining ring
40 offset center support brace
41 wear plate
42 abrasion wear plate
45 attachment blank
55 skid steer loading machine
60 lift arm
65 travel path "d"
70 travel path "r"
75 angular displacement "a"
80 forward travel path
85 reverse travel path
90 tilling bar
95 teeth
100 rotatable shaft
105 grade
110 surplus grade material

115 depression
120 loosened soil

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

Referring now to FIG. 1, an isometric view of the grading attachment 10 for a skid steer loading machine 55, according to the preferred embodiment of the present invention is disclosed. The grading attachment (herein described as the "device") 10, utilizes a front blade 15 connected to a series of four (4) stiffening plates 20 by four (4) hinge assemblies 25. The stiffening plates 20 are then connected to a grading frame 30 made of tube steel that is welded into a generally square shape. The grading frame 30 is then mechanically connected to an outer support sleeve 35 that is routed perpendicular to the front blade 15 at its midpoint. This mechanical connection is accomplished by a series of three (3) offset center support braces 40. Finally, the outer support sleeve 35 is placed over an inner support shaft 36. The inner support shaft 36 is welded to a base plate 37, envisioned to be a three-quarter inch (¾ in.) thick steel plate for structural reinforcement. The base plate 37 is welded to an attachment blank 45. The attachment blank 45 is of a universal design that connects to a standard skid steer machine as will be shown below. Additional structural reinforcement of the connection between the inner support shaft 36 and the base plate 37 is provided by a series of gusset plates 38. Once the inner support shaft 36 is inserted within the outer support sleeve 35 during initial assembly, it is retained in position by a welded retaining ring 39 which allows for rotation between the inner support shaft 36 and the outer support sleeve 35. A series of wear plates 41 are welded to all lower surfaces of the grading frame 30 to assist in leveling and flattening grade as necessary. An abrasion wear plate 41 is also attached to the front of the front blade 15.

Figure 2:
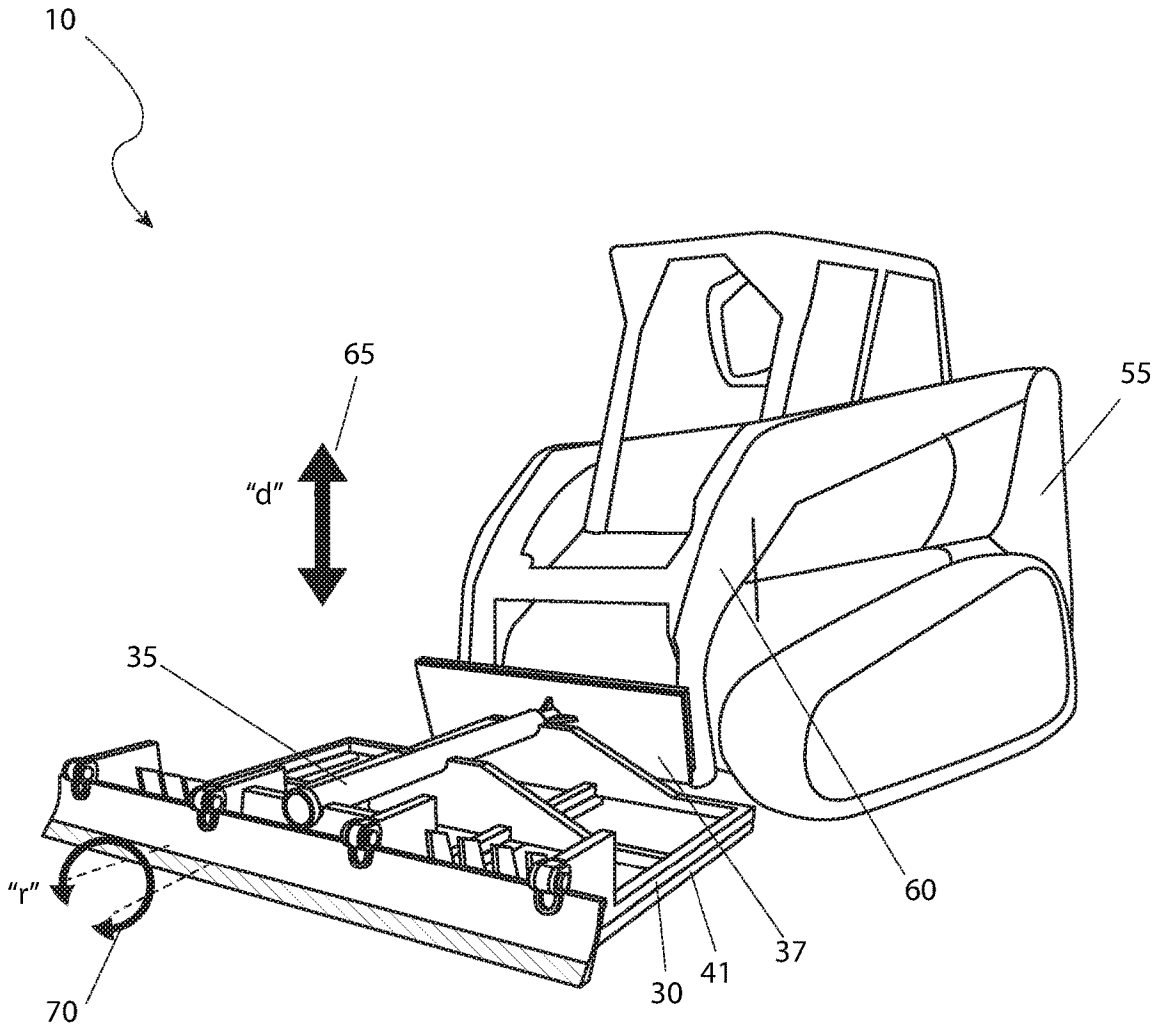
FIG. 2 is an isometric view of the grading attachment 10 for a skid steer loading machine 55 shown in an installed state on a skid steer machine 55, according to the preferred embodiment of the present invention.

Referring next to FIG. 2, an isometric view of the device 10 shown in an installed state on a skid steer loading machine 55, according to the preferred embodiment of the present invention is shown. The skid steer loading machine 55 is shown as skid steer machine which utilizes tracks for locomotion for purposes of illustration, although it should be noted that other versions which utilize pneumatic tires can also be used, and as such, should not be interpreted as a limiting factor of the present invention. The attachment blank 45 attaches to the lift arm 60 of the skid steer loading machine 55 in a conventional manner. As such, hydraulics aboard the skid steer loading machine 55 allow the device 10 to be moved up and down along a travel path "d" 65 as shown. The rotating action as provided between the inner support shaft 36 and the outer support sleeve 35 allows the device 10 to rotate as depicted by a travel path "r" 70. This feature allows for angular displacement of the bottom of the skid steer loading machine 55 from the outer support sleeve 35 on the device 10. As such, any grading actions performed by the device 10 are in alignment with the device 10 and not necessarily the alignment of the skid steer loading machine 55.

Figure 3:
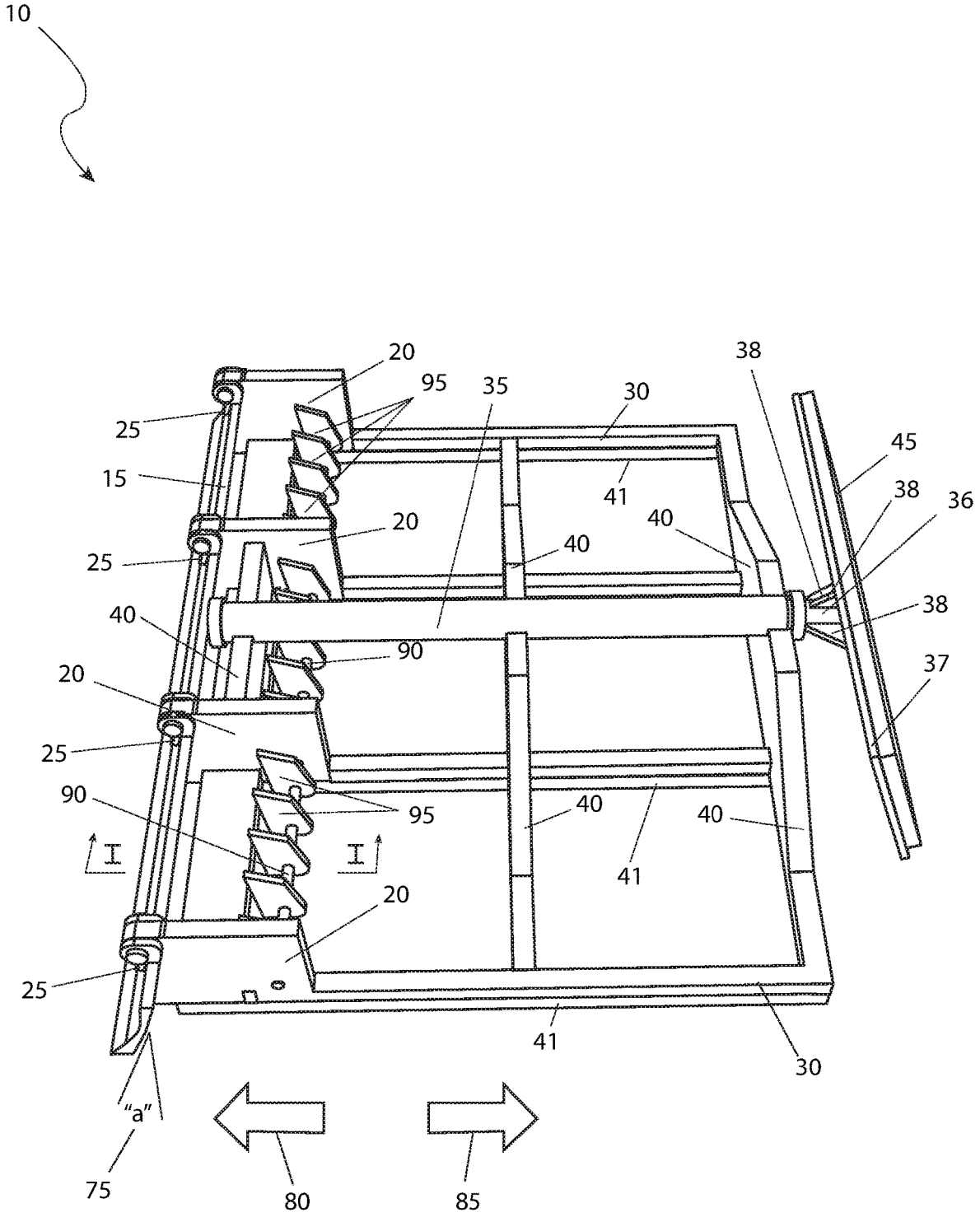
FIG. 3 is a side perspective view of the grading attachment 10 for a skid steer loading machine 55, according to the preferred embodiment of the present invention.

Referring now to FIG. 3, a side perspective view of the device 10, according to the preferred embodiment of the present invention is disclosed. The front blade 15 is permitted to move through an angular displacement "a" 75 via the four (4) hinge assemblies 25 connected to the four (4) stiffening plates 20. Thus, when the device 10 is moved in a forward travel path 80, the front blade 15 functions as a bulldozer blade to push loose grade material forward. Likewise, when the device 10 is moved in a reverse travel path 85, the front blade 15 simply glides over the loose grade material, leaving it mainly in place for subsequent movement during a forward travel path 80. This feature eliminates the necessity of having to raise and lower the device 10 via the lift arm 60 (as shown in FIG. 2) during each pass, thus saving time as well as wear and tear on the skid steer machine 55 (as shown in FIG. 2). The device 10 also holds three (3) tilling bars 90, each of which is held in position between the three (3) sets of stiffening plates 20 on each side of the device 10. The tilling bars 90 are capable of being retracted or deployed by hand. An alternate embodiment is envisioned which allows for hydraulic deployment. When deployed, the tilling bars 90 allow for quick removal and loosening of hardened grade material when the device 10 is moved in a reverse travel path 85. All components of the device 10 would be made of carbon steel that are attached via welding. After manufacture, a suitable protective finish such as paint or plating would be applied to prevent corrosion. This figure also depicts the attachment of the grading frame 30 to the outer support sleeve 35 via the offset center support braces 40 as well as the attachment of the outer support sleeve 35 to the inner support staff 36 to the base plate 37 and finally the attachment blank 45.

Figure 4:
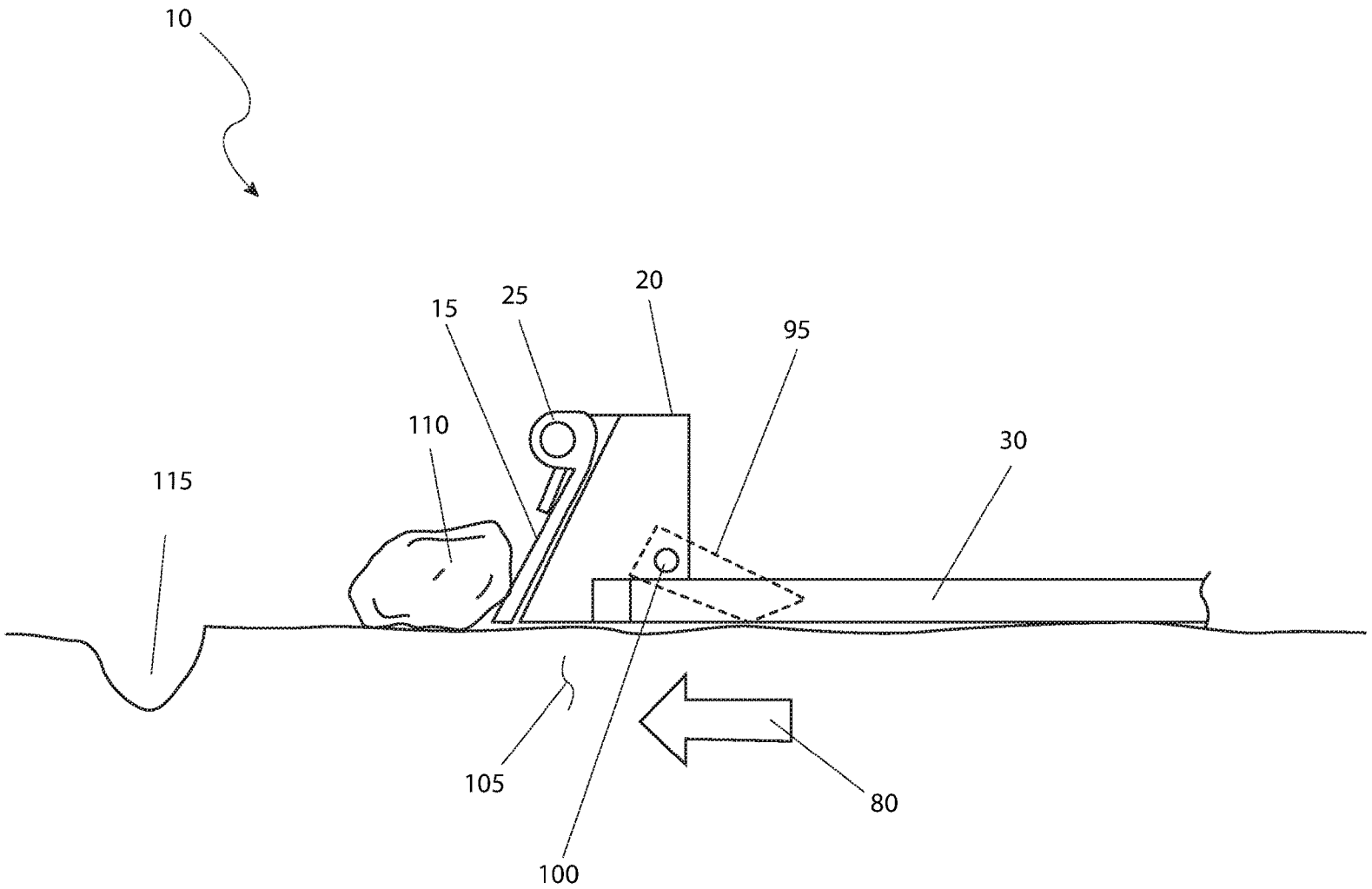
FIG. 4 is a sectional view of grading attachment 10 for a skid steer loading machine 55 as seen along a line I-I, as depicted in FIG. 3, with the tilling bars 90 in a retracted position, according to the preferred embodiment of the present invention.

Referring next to FIG. 4, a sectional view of device 10 as seen along a line I-I, as depicted in FIG. 3, with the tilling bars 90 in a retracted position, according to the preferred embodiment of the present invention is depicted. The tilling bars 90 consists of multiple teeth 95 (of which only one (1) is shown due to illustrative limitations) that are welded onto rotatable sleeves 100 and supported between the stiffening plates 20. The teeth 95 are projecting upward as to not contact the grade 105. Thus, as the device 10 proceeds in a forward travel path 80, surplus grade material 110 builds up in front of the front blade 15 where it will fill in depressions 115. The front blade 15 is positioned at an angle of approximately eighteen degrees (18°) to achieve a constant sharp cut of the grade. Additionally, the structural components of the grading frame 30 will also ensure the grade 105 will be smooth and level and ready for seeding.

Figure 5:
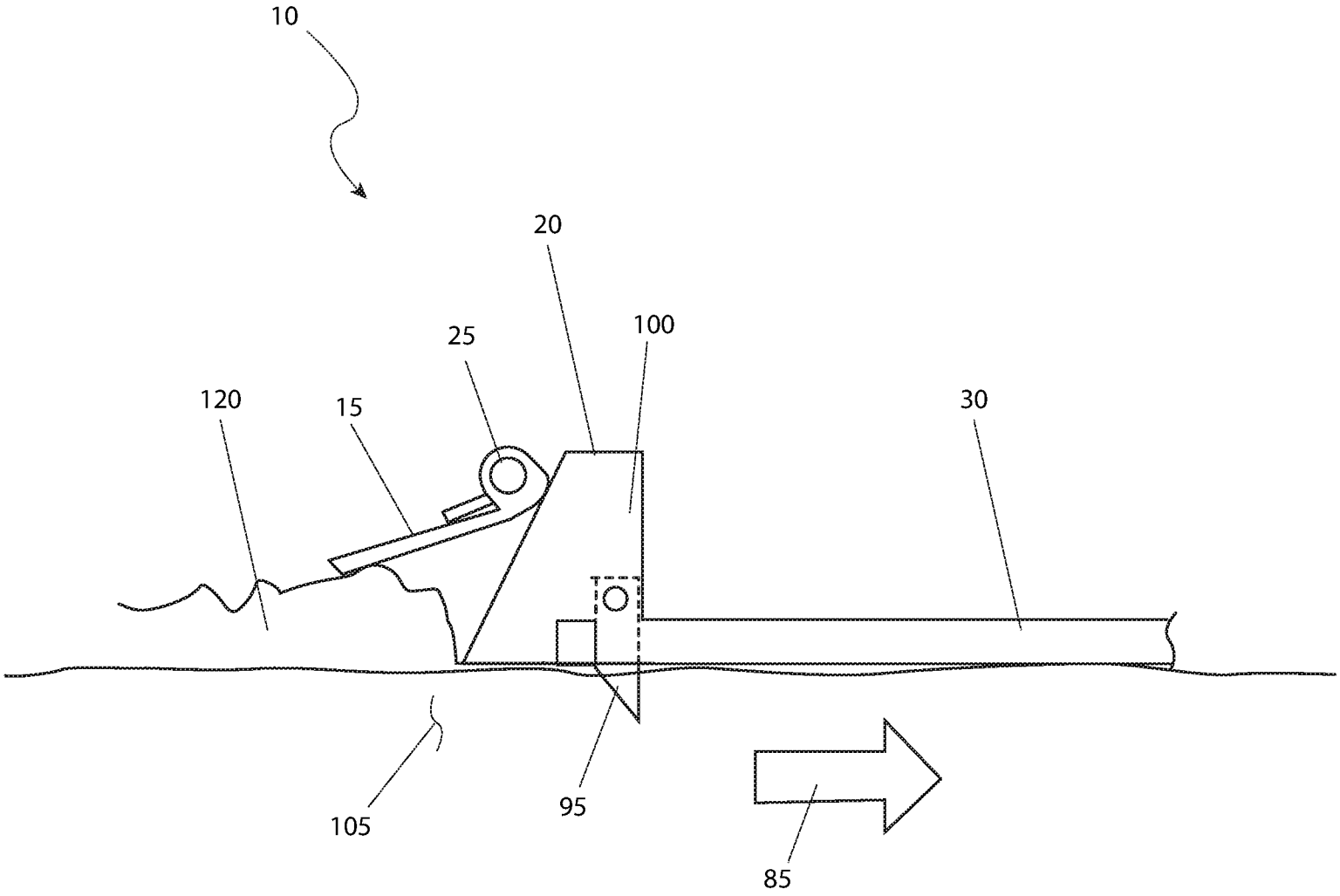
FIG. 5 is a sectional view of grading attachment 10 for a skid steer loading machine 55 as seen along a line I-I, as depicted in FIG. 3, with the tilling bars 90 in a deployed position, according to the preferred embodiment of the present invention; and, FIG. 6 is an isometric view of the grading attachment 10 for a skid steer loading machine 55 having a hydraulic cylinder 125, according to a different embodiment of the present invention.
Figure 6:
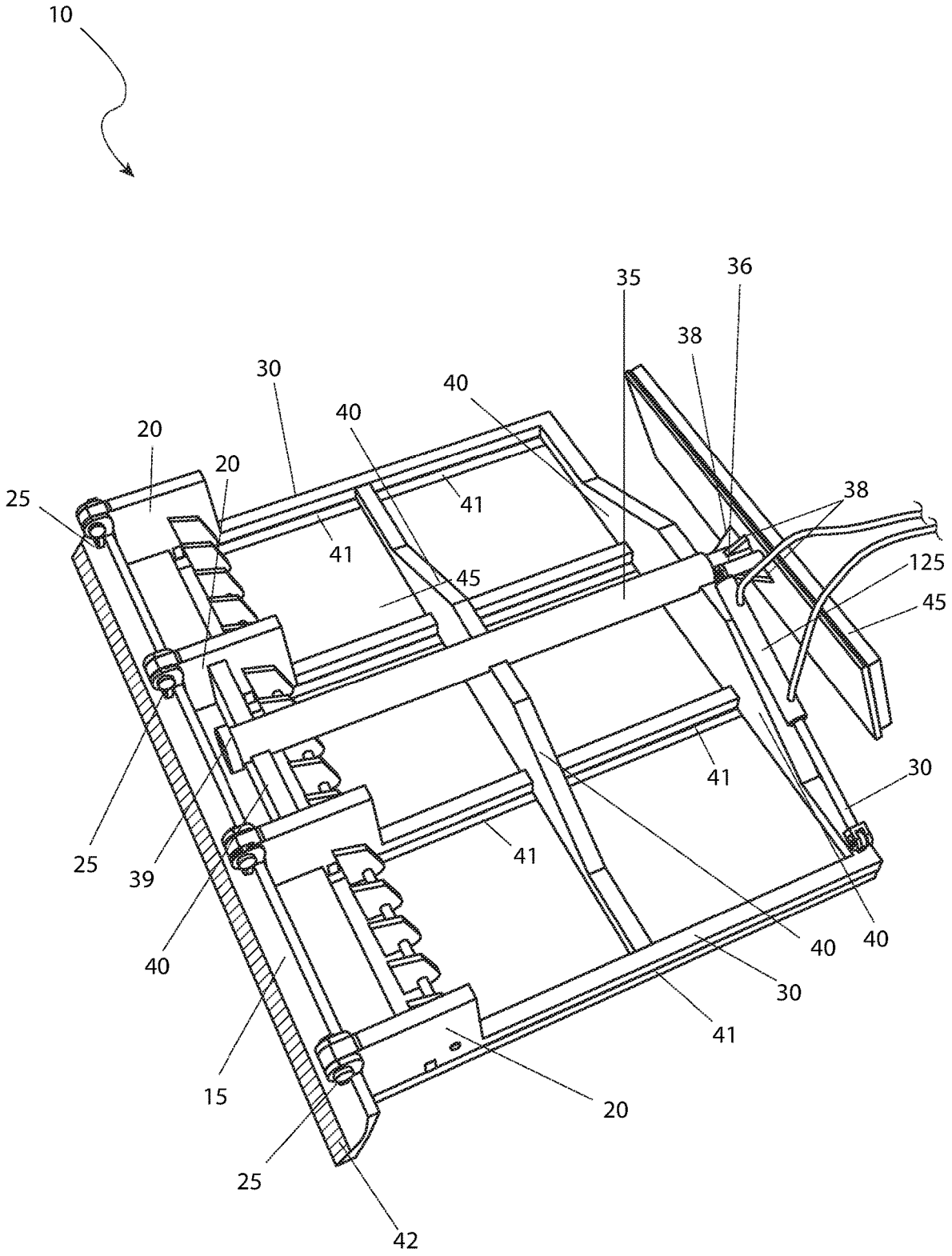

Referring finally to FIG. 5, a sectional view of device 10 as seen along a line I-I, as depicted in FIG. 3, with the tilling bars 90 in a deployed position, according to the preferred embodiment of the present invention is shown. The teeth 95 along with the rotatable shafts 100 are manually rotated as a single unit approximately one hundred eighty degrees (180°) from the orientation shown in FIG. 4. Said orientation permits the teeth 95 to extend below the lower plane of the grading frame 30 and into the grade 105. Next, as the device 10 is moved in a reverse travel path 85, the teeth 95 will dig or "rip" the grade 105 and allow the operator to produce loosened soil 120. When teeth 95 are in a down position, they function as the front blade 15, eliminating the need to raise and lower the device 10. Any loosened soil 120 is broken or "churned" down to produce a fine final grade by the front blade 15. Since the front blade 15 is not held captive and is able to pivot on the hinge assemblies 25, the front blade 15 will ride on top of the loosened soil 120 and will not compact it or move it. Thus, on a subsequent forward travel path 80 (as shown in FIG. 4), the loosened soil 120 will become surplus grade material 110 (as shown in FIG. 4) and will be distributed into depressions 115 (as shown in FIG. 4). In such a manner, the operator of the device 10 can reduce high points in the grade profile during final grading operations. It should also be noted that the grading frame 30 acts similar to a drag on a screening device whereupon it automatically breaks down, pulverizes, and levels large clods and clumps of dirt into final grade material where it becomes an excelled seed bed. Said functionality is a primary function of the device 10 where it can reduce the amount of additional work required by landscapers while producing an excellent finished surface.

The preferred embodiment of the present invention can be utilized by the common user in a simple and effortless manner with little or no training. It is envisioned that the device 10 would be constructed in general accordance with FIG. 1 through FIG. 5. For example, an additional embodiment contemplated by the inventor would permit an operator to position the device at a selectable angle by means of a hydraulic cylinder 125 which would be mounted to the base plate 37 and a rear upper surface of the grading frame 30 adjacent said base plate 37. Please see FIG. 6.

General manufacturing processes such as steel cutting, welding, finishing and painting would be utilized. Should large scale production of the present invention be undertaken, suitable jigs and other assembly aids would be needed to speed production and ensure consistency. The universal adaptation features of the attachment blank 45 allows the device 10 to be utilized with a wide variety of different makes and models of skid steer loading machine 55. Once the device 10 is attached to the lift arm 60 of the skid steer loading machine 55 using the manufacturer supplied attachment means, grading operations are ready to begin.

Grading operations utilizing the device 10 would commence using a series of repeating motions that follow the forward travel path 80 and the reverse travel path 85. Should portions of high profile grade need to be reduced, the operator would stop the skid steer loading machine 55, and manually turn the rotatable shafts 100 so that the teeth 95 protrude into the grade 105. The operator would then perform a series of reverse travel path 85 over the high-profile grade to loosen it. It should be noted that the front blade 15 would not flatten out the surplus grade material 110 as the hinge assemblies 25 allow the front blade 15 to pivot out of the space occupied by the surplus grade material 110. Subsequently, alternating passes with the device 10 along a forward travel path 80 as well as a reverse travel path 85 will level out the grade so that any depressions 115 are filled in. Such process would continue until the entire area being graded is completed. This described functionality produces a finished grade that is level and immediately purposed for seeding, sod, or other similar functionality. At this point in time, the device 10 may be removed from the skid steer machine 55 so that other attachments may be utilized.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A grading attachment, comprising:

a grading frame having an outer support sleeve attached thereto via a plurality of support braces;

an inner support shaft secured to an end of said outer support sleeve further having a distal end directly affixed to a base plate;

an attachment blank affixed to said base plate;

a plurality of stiffening plates each connected to said grading frame;

a front blade hingedly attached to each of said stiffening plates;

a plurality of gusset plates affixing said inner support shaft to said base plate;

a plurality of wear plates affixed to lower surfaces of said grading frame;

an abrasion wear plate attached to said front blade; and a plurality of tilling bars each held in position between adjacent ones of said stiffening plates;

wherein said inner support shaft rotates within said outer support sleeve;

wherein said attachment blank is configured to attach to a skid steer loading machine thereby enabling said skid steer loading machine to operably control said grading attachment;

wherein each of said wear plates further comprises high carbon steel;

wherein a plurality of teeth further comprises high carbon steel;

wherein said grading frame comprises a hydraulic cylinder secured to said base plate at a first end and secured to said grading frame at a second end;

wherein movement of said hydraulic cylinder in a first direction moves said grading frame in a first direction;

wherein movement of said hydraulic cylinder in a second direction moves said grading frame in a second direction;

wherein said grading frame further comprises a rectangular shape; and wherein each of said tilling bars further comprise said high carbon steel teeth.

2. A grading machine, comprising:

a skid steer loading machine;

a grading frame having an outer support sleeve attached thereto via a plurality of support braces;

an inner support shaft secured to an end of said outer support sleeve further having a distal end affixed to a base plate;

an attachment blank affixed to said base plate;

a plurality of stiffening plates each connected to said grading frame;

a front blade hingedly attached to each of said stiffening plates;

a plurality of gusset plates affixing said inner support shaft to said base plate;

a plurality of wear plates affixed to lower surfaces of said grading frame;

an abrasion wear plate attached to said front blade;

a plurality of tilling bars each held in position between adjacent ones of said stiffening plates; and wherein said inner support shaft rotates within said outer support sleeve;

wherein said attachment blank is configured to attach to a skid steer loading machine, thereby enabling said skid steer loading machine to operably control said grading attachment;

wherein each of said wear plates further comprises high carbon steel;

wherein each of said tilling bars further comprise a plurality of teeth; and wherein said teeth further comprise high carbon steel; and wherein said grading frame further comprises a rectangular shape.

3. A grading attachment, comprising:

a grading frame having an outer support sleeve attached thereto via a plurality of support braces;

an inner support shaft secured to an end of said outer support sleeve further having a distal end affixed to a base plate;

an attachment blank affixed to said base plate;

a plurality of stiffening plates each connected to said grading frame;

a front blade hingedly attached to each of said stiffening plates;

a hydraulic cylinder secured to said base plate at a first end and secured to said grading frame at a second end;

a plurality of gusset plates affixing said inner support shaft to said base plate;

a plurality of wear plates affixed to lower surfaces of said grading frame;

an abrasion wear plate attached to said front blade; and a plurality of tilling bars each held in position between adjacent ones of said stiffening plates;

wherein said inner support shaft rotates within said outer support sleeve;

wherein said attachment blank is configured to attach to a skid steer loading machine thereby enabling said skid steer loading machine to operably control said grading attachment;

wherein movement of said hydraulic cylinder in a first direction moves said grading frame in a first direction;

wherein movement of said hydraulic cylinder in a second direction moves said grading frame in a second direction; and wherein each of said tilling bars further comprise a plurality of high carbon steel teeth.

* * * * *